US006001045A

United States Patent [19]

Gift et al.

[11] Patent Number: 6,001,045

[45] Date of Patent: Dec. 14, 1999

[54] TRAMPOLINE SAFETY PAD

[75] Inventors: J. Paul Gift; Charles W. Bookstaver, both of Columbus, Miss.

[73] Assignee: F.F. Acquisition Corp., West Point, Miss.

[21] Appl. No.: 09/019,887

[22] Filed: Feb. 6, 1998

Related U.S. Application Data

[63] Continuation-in-part of application No. 09/006,728, Jan. 14, 1998, abandoned.

[51] Int. Cl.[6] ..... A63B 5/11

[52] U.S. Cl. ..... 482/27; 482/28

[58] Field of Search ..... 482/27, 28; 182/135–138

[56] References Cited

U.S. PATENT DOCUMENTS 3,983,585 10/1976 Sidlinger ..... 182/138

5,385,518 1/1995 Turner ..... 482/27

*Primary Examiner*—Jerome Donnelly

*Attorney, Agent, or Firm*—Brinks Hofer Gilson & Lione

[57] ABSTRACT

A safety pad for use on a trampoline is provided. Preferably, the pad includes an exposed closed cell foam upper surface and is sized and shaped to substantially cover trampoline springs holding a bouncing surface to a frame and the frame. In one embodiment the trampoline safety pads may be attached to a trampoline frame by slidably disposing the pads along a trampoline frame member. In another embodiment the pads may be attached to the frame using cords.

13 Claims, 3 Drawing Sheets

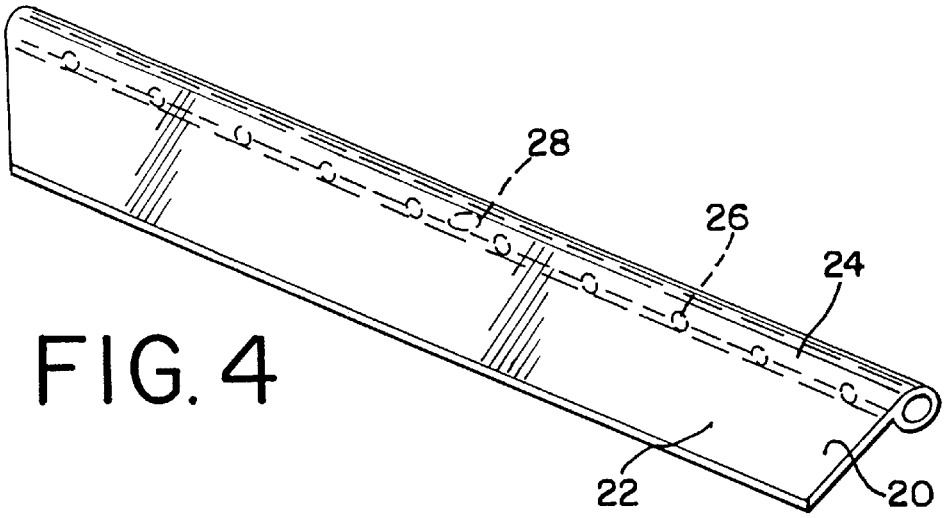
FIG. 4
FIG. 5
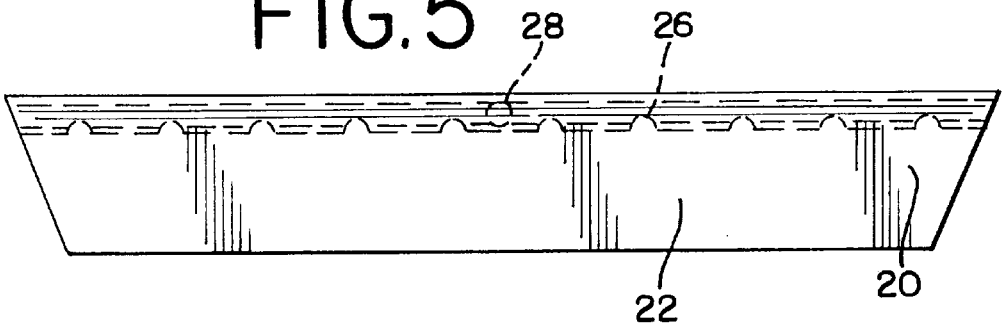
FIG. 6
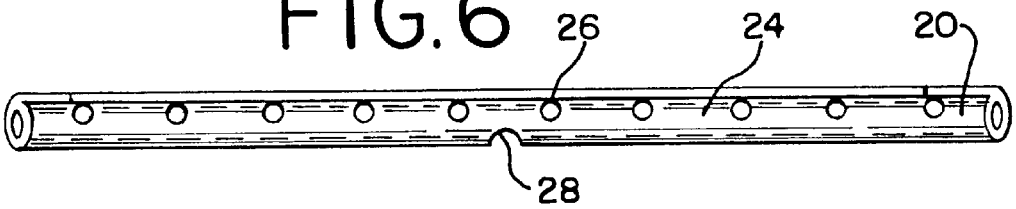
FIG. 7
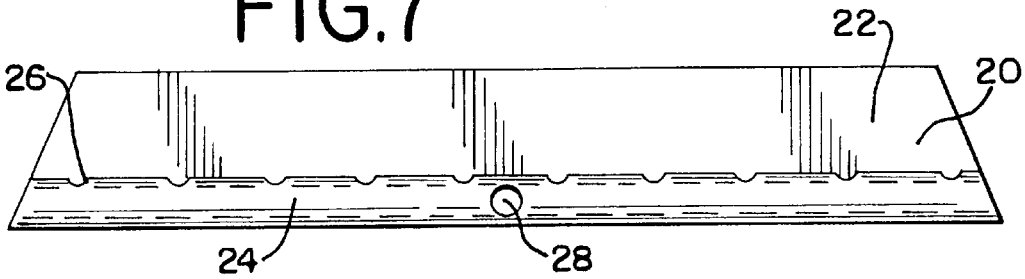

TRAMPOLINE SAFETY PAD

CROSS REFERENCE TO RELATED APPLICATION

This application is a continuation-in-part of application Ser. No. 09/006,728 filed Jan. 14, 1998, which is incorporated herein by reference now abandoned.

BACKGROUND OF THE INVENTION

The present invention relates to trampolines, and more particularly to trampoline safety pads which cover the trampoline frame and trampoline springs and which have a unique shape, attachment method and method of manufacture.

Children and adults enjoy using trampolines for various exercises and recreation. During use a danger exists that the person on the trampoline may fall off onto the frame or into the area between the bouncing surface and the trampoline frame. Federal consumer protection safety laws require trampolines to have some type of pad on the trampoline frame.

Some trampolines have protective covers over not only the trampoline frame, but also over the area between the bouncing surface and the trampoline frame where the springs are located. Typical covers include die cut foam pads covered by a fabric and sewn together. The pad has ties that tie to the trampoline frame.

One problem with existing trampoline safety pads and covers is that they are made from low grade foam and require separate fabric covers; thus they are expensive to manufacture and not very sturdy. Further, the pads are usually made as one continuous piece to cover the springs and frame or the frame for the entire trampoline. This creates a very high cost of replacement if part of the pad or its covering is damaged and needs to be replaced. Another problem with the current trampoline covers and pads is that they may shift with use because they are tied to the frame only with straps.

A need exists for a pad that is easily replaceable, made of a sturdy material and may be manufactured for a low cost. Also, there is a need for a trampoline safety pad that is more securely attached to the trampoline frame.

SUMMARY OF THE INVENTION

A unique trampoline safety pad, method of attaching the pad to the trampoline and method of manufacturing the pad has been invented which overcomes many of the deficiencies noted above.

In a first aspect, the present invention is a trampoline safety pad comprising a first section sized and shaped to substantially cover trampoline springs holding a bouncing surface to a trampoline frame; and a second section adjacent and connected to the first section comprising a preformed collar member shaped to at least partially cover a horizontal frame member of the frame, the preformed collar member having a series of openings along its length sized and shaped to allow trampoline springs to pass through the collar member to connect to the frame.

In a second aspect, the present invention is a method of attaching trampoline safety pads to a trampoline comprising a trampoline frame formed of tubular members, a bouncing surface and springs located between the trampoline frame and the bouncing surface, the method comprising the steps of: slidably disposing a trampoline safety pad having a series of openings along a tubular member having a series of spring holes; and joining two trampoline frame body parts within the collar member of the trampoline safety pad; and positioning the pad back so that the openings overlie the spring holes.

In a third aspect the present invention is a method of manufacturing a trampoline safety pad comprising the steps of: extruding a first section and a collar member; forming a series of openings sized to accept trampoline springs within and along the length of the collar member; and forming an opening at the center of the collar member sized to accept a vertical frame member.

In a fourth aspect the present invention is a trampoline safety pad comprising a closed cell foam member sized and shaped to substantially cover trampoline springs and a horizontal frame member.

In a fifth aspect the present invention is a trampoline safety pad comprising a pad member having an exposed foam surface, the pad member being sized and shaped to substantially cover trampoline springs and a horizontal frame member, the pad member being comprised of: a first layer; and a second layer; a connector to secure the pad member to the trampoline frame; and a flap to secure the pad member to an adjacent pad member.

In a sixth aspect the present invention is a trampoline safety pad comprising: a trapezoidal shaped foam pad sized to cover trampoline springs holding a bouncing surface to a frame and to partially cover a horizontal frame member of the frame; a pair of grommets at ends of the foam pad; a central grommet on an edge of the pad; and a plurality of cords running through said grommets to secure the foam pad to an adjacent foam pad and to the frame.

In a seventh aspect the present invention is a method of attaching trampoline safety pads to a trampoline comprising a trampoline frame formed of tubular members, a bouncing surface and springs located between the trampoline frame and the bouncing surface, the method comprising the steps of: placing a first trampoline safety pad having grommets and a flap on a trampoline frame; passing cords through said grommets; securing said cord from said first safety pad to a horizontal frame member; placing the edge of a second safety pad underneath the flap of the first pad; securing cords of said first and second safety pads together; and securing a cord from the connected trampoline pads to a leg joiner tube.

In an eighth aspect the present invention is a method of manufacturing a trampoline safety pad comprising the steps of superimposing a first layer of closed cell foam upon a second layer of closed cell foam; forming the first and second layers of closed cell foam into a predetermined shape; laminating the first layer of closed cell foam to the second layer of closed cell foam; cutting slits along a portion of the second layer of closed cell foam so that the first layer of foam may wrap around a horizontal frame member; forming openings along the edges of the first and second layers of foam; and pressing grommets into the openings.

The preferred embodiments of the present invention provide a new trampoline safety pad, in which closed cell polyethylene foam used for the pad is much sturdier than low grade polyethylene foam used in die cut pads. In addition, the pad does not require a covering, which reduces its cost and makes it easier to manufacture. In a first embodiment the pad is uniquely formed. The pad includes a preformed collar that wraps around the trampoline frame and contains a series of openings for trampoline springs. This allows the pad to be securely attached so it does not shift with use. In another embodiment, the pad contains grommets and is attached by passing cords through the grommets and tying the cords to the trampoline frame. This embodiment is also secure and easy to manufacture.

The trampoline safety pad is attached in sections so that one section may be replaced if necessary instead of purchasing an entire cover for the trampoline. Finally the first embodiment of the trampoline safety pad may be extruded with a preformed collar member, which allows it to be slidably disposed along the trampoline frame, and then punched with a series of openings that match the spring holes of the trampoline frame, thereby reducing the cost of manufacture of such a covering device. In another embodiment the pad is manufactured by superimposing two layers of closed cell foam and cutting these layers into an appropriate shape.

These and other advantages of the invention, as well as the invention itself, will be best understood in the light of the attached drawings, a brief description of which follows:

BRIEF DESCRIPTION OF THE DRAWINGS

FIG. 4 is a perspective view of the trampoline safety pad of FIG. 1.

FIG. 5 is a top plan view of the trampoline safety pad of FIG. 4.

FIG. 6 is a front elevational view of the trampoline safety pad of FIG. 4.

FIG. 7 is a bottom plan view of the trampoline safety pad of FIG. 4.

DETAILED DESCRIPTION OF THE DRAWINGS AND PRESENTLY PREFERRED EMBODIMENTS OF THE INVENTION

In a preferred embodiment, the trampoline safety pads of the present invention are made of a closed cell foam member and an exposed foam surface. In the present context, exposed means that the upper surface is exposed to weather, and not covered by a separate fabric or plastic cover over the foam.

Figure 1:
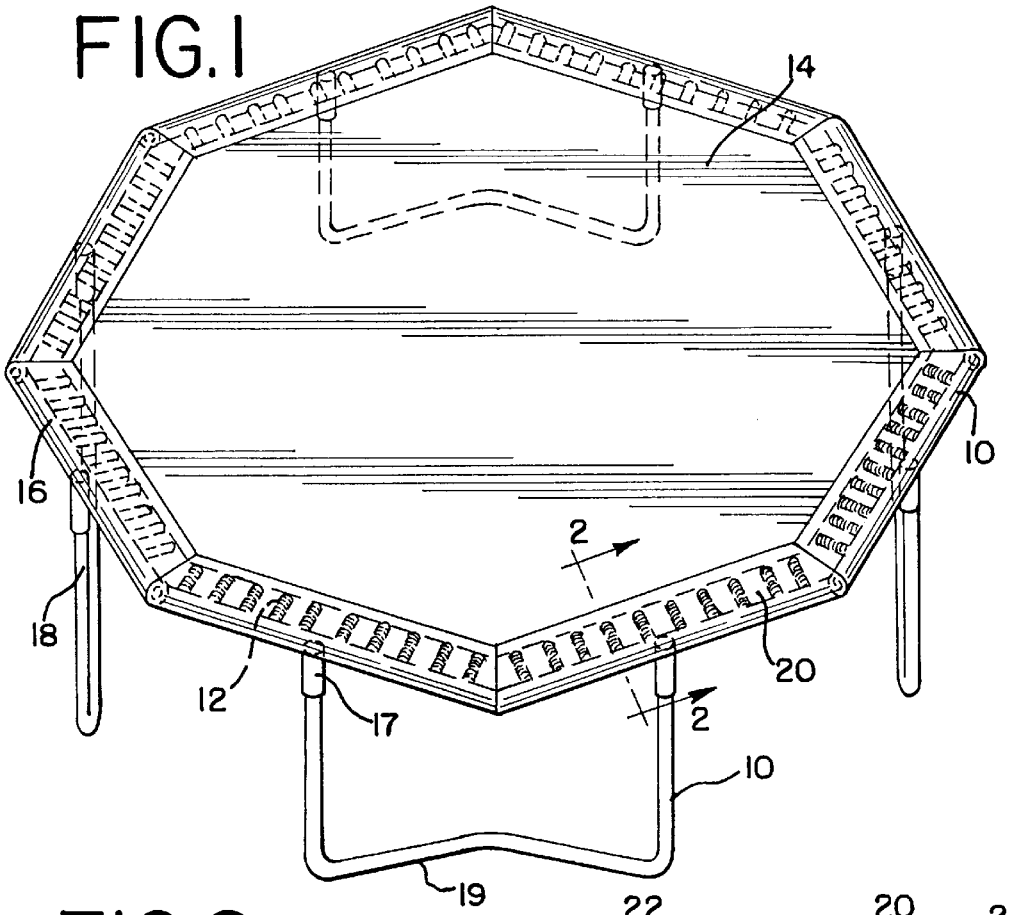
FIG. 1 is a perspective view of a conventional trampoline and a first embodiment of the trampoline safety pad of the present invention.

As shown in FIG. 1, a number of trampoline safety pads 20 of a first embodiment of the present invention are attached to a trampoline frame 10. Each trampoline safety pad 20 partially or completely covers trampoline springs 12, which hold a bouncing surface 14 to the trampoline frame 10. The frame 10, springs 12 and bouncing surface 14 are conventional, and described further herein only to the extent necessary to describe the invention.

The trampoline frame 10 has both horizontal frame members 16 and vertical frame members 18. In a preferred embodiment, these frame members are cylindrical steel tubes. They provide support for the bouncing surface 14, and are linked to the bouncing surface 14 via the trampoline springs 12.

As shown in FIG. 1, the vertical frame members 18 form legs which are connected at their bottom to another leg by a cross piece 19. In a preferred embodiment, the horizontal frame members 16 are attached to one another using telescoped ends. The horizontal frame members include a leg joiner tube 17 welded onto their bottom. The leg 18 fits into the tube 17 to connect the leg 18 to the horizontal frame member. In FIG. 1, the horizontal frame members 16 are attached to form an octagon shaped trampoline frame 10. However, the trampoline frame members could be joined to form a variety of shapes including a hexagon, rectangle, circle and an ellipse. The legs 18 attach to the horizontal frame members 16 at a location central to each octagonal side of the trampoline.

A first embodiment of the trampoline safety pad 20 shown in FIGS. 2 and 4–7 is designed to fit onto horizontal frame members 16 that join near the center of the straight parts of the octagon, next to where the leg joiner tube 17 is welded on. If the frame member were designed differently, the safety pads would be modified to fit the shape of the frame member, taking into account the location of any leg joiner tube 17.

Figure 2:
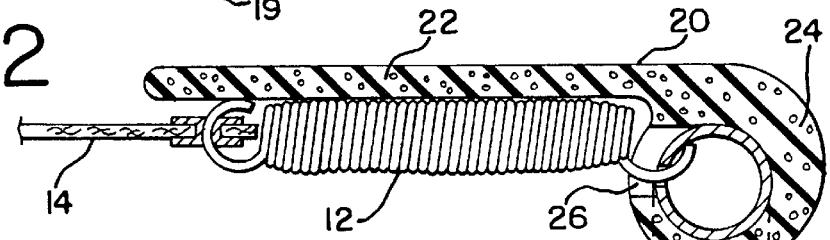
FIG. 2 is a cross-sectional view taken along line 2—2 of FIG. 1.

In FIG. 1, the bouncing surface 14, like the frame, is octagonal in shape. Also, like the frame, the bouncing surface 14 can have a variety of shapes such as hexagonal, elliptical, rectangular, or circular. The bouncing surface 14 provides an elasticized area for individuals to perform activities such as acrobatics, flips and various exercises. It is attached to and held by the trampoline frame 10 using trampoline springs 12. As shown in FIG. 2, one end of the spring 12 is hooked onto the bouncing surface 14 and the other end passes through an opening 26 in the trampoline safety pad 20 and a spring hole in the horizontal frame member 16 and hooks onto the inside of the horizontal frame member 16.

The safety pad 20 is composed of two sections. In a preferred embodiment, the trampoline safety pad's first section 22 is polyhedral. As best seen in FIGS. 5 and 7, the pad's first section 22 can be trapezoid shaped. It may be comprised of a closed cell polyethylene foam and also may be comprised of alternative materials such as cross linked polyethylene, open celled polyurethane and rim molded polyurethane. Preferably the foam used to construct the pad 20 is high density foam.

The first section 22 acts to cover the trampoline springs 12 (FIG. 1). In a preferred embodiment, the first section 22 completely covers the area between the trampoline frame 10 and the bouncing surface 14. However, in some embodiments the springs 12 may be longer than the width of the first section. The first section 22 may be attached to the second section of the pad using a heat weld or it may be formed as a monolithic unit with the second section. The second section of the pad is a preformed collar member 24, which constitutes a connector for securing the pad to the trampoline frame. In a preferred embodiment, the preformed collar member 24 is cylindrical in shape. The preformed collar member 24 may be composed of the same material used to make the first section 22, a closed cell polyethylene foam. In a preferred embodiment, the preformed collar member 24 is a cylinder that is slidably disposed along the horizontal frame member 16 and acts to secure the trampoline safety pad 20 onto the horizontal frame member 16.

The preformed collar member 24 contains openings 26 along its length. These openings 26 allow the trampoline springs 12 to hook into the horizontal frame member 16. The openings 26 are spaced apart and are located on the collar member 24 so that when the pad 20 is disposed along a horizontal frame member 16, the openings 26 match the spring holes on the frame member 16.

A central opening 28 is located on the bottom of the preformed collar member 24. The central opening 28 may be circular in shape. The location of the central opening 28 on the preformed collar member 24 matches that of the leg joining tube 17 designed to accommodate the vertical frame member 18. Thus, the opening allows the pad 20 to be slidably disposed along the horizontal frame member 16 and still accommodate the joining of the vertical frame member 18 to the horizontal frame member 16. The central opening 28 is located along the center of the length of the preformed collar member 16 and disposed at essentially 90 degrees from the openings 26 designed to accommodate the springs 12. The central opening is sized to fit around the leg joining tube 17.

The following explains the method of attaching the first embodiment of the trampoline safety pad 20 to a trampoline frame 10. First, the preformed collar member 24 is slid onto the horizontal frame member 16 by inserting the small end of the frame member 16 through the hole 28 and directing that end toward the side of the safety pad 20. The other end of the frame member 16 has a leg joining tube welded onto it. As the frame member is disposed further and further through the collar member 24, eventually the small end of the frame member 16 will extend out of the collar member 24. The frame member 16 is further advanced until half of the frame member 16 extends beyond the end of the pad 20, and the hole 28 is then stretched over the back end of the frame member 16 and left with the leg joining tube 17 sticking out of the hole 28. Each of the pads 20 and frame members 16 are joined together in this fashion.

Next the small end of one of the frame members 16 already protruding out of the end of a collar member 24 is inserted in the unoccupied end of a collar member 24 of a second combined frame member 16/pad 20. The frame member 16 is pushed in until it fits into the large end of the other frame member 16 that is disposed inside of the collar member of the second pad. As the two frame members 16 come together, the ends of the safety pad sections 20 will also come together. The vertical frame members 18 are next inserted into the leg joining tubes 17.

Finally, the trampoline safety pad 20 is positioned to match the pad openings 26 with the spring holes in the horizontal frame member 16. This may be facilitated by pulling the pad 20 back to expose the openings. The springs are then connected between the bouncing surface 14 and the frame members 16. The foregoing steps should be repeated until the entire trampoline frame member is covered by trampoline safety pads 20. In the event that a pad needs to be replaced, the horizontal frame members would be disconnected, the pad removed, and then another pad installed by repeating the foregoing steps.

The following steps describe a method of manufacturing the trampoline safety pad 20. First, the first section 22 and the preformed collar member 24 are extruded and out into appropriate lengths and shapes. Second, openings 26 sized to accept trampoline springs 12 are formed along the length of the preformed collar member 24. Next, a central opening 28 is formed at the center along the length of the collar member 24.

In a preferred method of manufacture the first section 22 has an approximate width of 9 inches. The preformed collar member has an inside diameter of about 1 13/16 inches. Further, the openings 26 along the collar member are spaced 5–6 inches apart and each opening has a diameter of approximately 1½ inches. In this preferred method of manufacture, the trampoline safety pad 20 is trapezoidal in shape and the longer side of the pad is approximately 59 11/16 inches in length while the shorter side is approximately 52¼" in length. The central opening 26 is located about 30 3/16 inches from the edge of the longer side of the pad in the approximate center of the preformed collar member 24. Finally the angle formed by the ends of the trampoline safety pad 20 is about 67.5 degrees.

In an alternative method of manufacture first, the first section 24 and the preformed collar member 24 are extruded separately and then attached together using a heat or solvent weld. Second, openings 26 sized to accept trampoline springs 12 are formed along the length of the preformed collar member 24. Next, a central opening 28 is formed at the center along the length of the collar member 24. The openings 26 and central opening 28 may be formed before the first and second sections are welded together.

Figure 3:
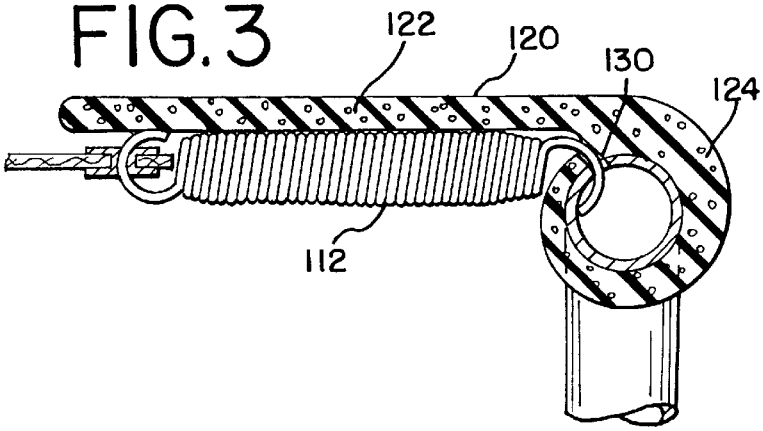
FIG. 3 is a cross-sectional view similar to FIG. 2 but showing a second embodiment of the invention.

As shown in FIG. 3, in the second embodiment of the trampoline safety pad 120 the preformed collar member 126 has spring connection openings in the form of one continuous slit 130 along its entire length, rather than the spaced holes 26. In this alternative embodiment the springs 112 pass through the slit 130 and hook onto the inside of the horizontal frame member 116. In a preferred method of manufacture this slit has a width of ¼". Also, this slit 130 may be cut after the preformed collar member 124 is extruded. The attachment method of the second embodiment is similar to the first embodiment, however, instead of sliding the preformed collar member 126 on the horizontal frame member 116, the preformed collar member 126 can be opened at the slit 130 as wide as the diameter of the horizontal frame member 116 and placed over the horizontal frame member 116.

Figure 8:
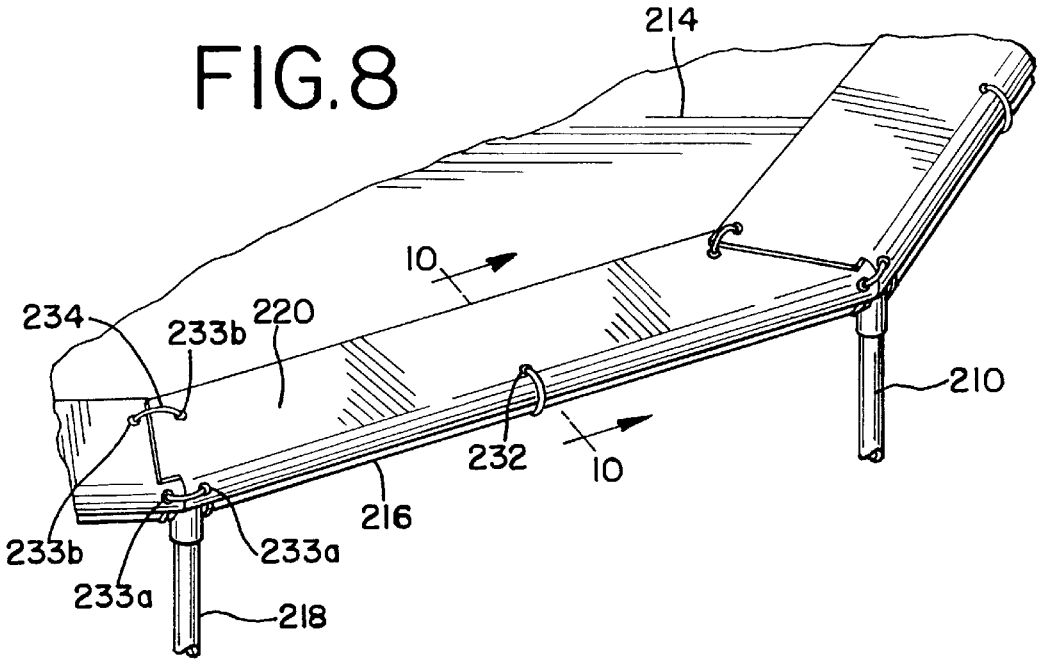
FIG. 8 is a perspective view of a conventional trampoline and a third embodiment of a trampoline safety pad of the present invention.
Figure 9:
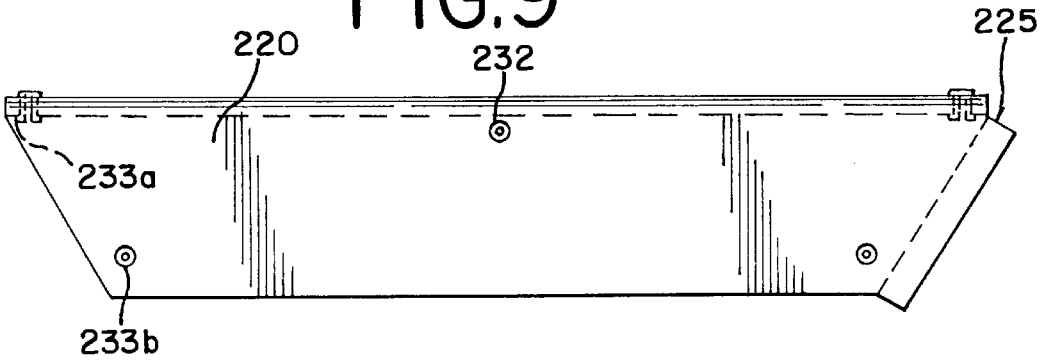
FIG. 9 is a top plan view of the trampoline safety pad of FIG. 8.
Figure 10:
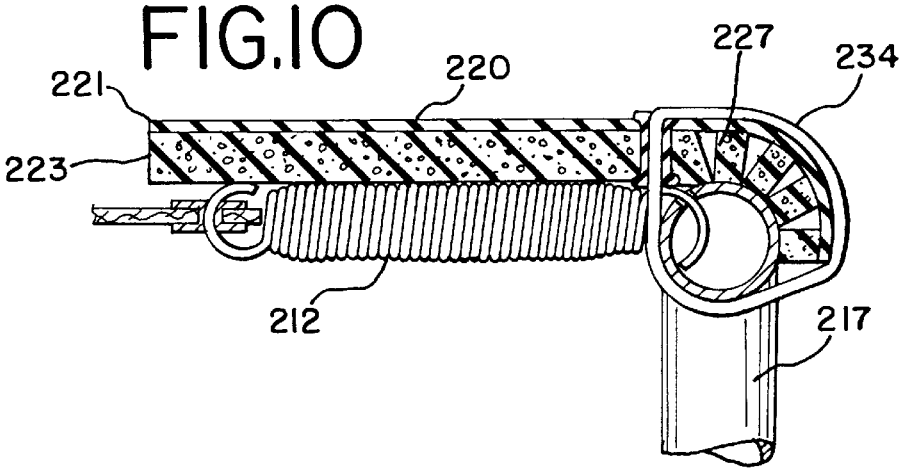
FIG. 10 is a cross sectional view taken along line 10—10 of FIG. 8.

The third embodiment of the trampoline safety pad 220 is shown in FIGS. 8–10. Unlike the first two embodiments, in the third embodiment the pad 220 does not necessarily cover the entire horizontal frame member, and is thus attached with cords. In the embodiment of the trampoline safety pad 220 shown in FIGS. 8 and 9, the spring 212 is also hooked onto the bouncing surface 214 and the other end is hooked into the spring hole in the horizontal frame member 216 before the pad 220 is installed.

The pad member 220 is generally trapezoidal shaped. However, as best shown in FIG. 9, one end of the pad 220 has a rectangular shaped flap 225. The flap 225 is integral to the pad 220 and is formed when the pad 220 is cut. The flap 225 facilitates the attachment of a pad 220 to an adjacent pad 220, by overlapping the adjacent pad 220.

As depicted in FIG. 10, the trampoline safety pad 220 is composed of two layers. The first layer 221 is closed cell foam with an exposed upper surface while the second layer 223 is also made up of closed cell foam, but is thicker than the first layer. The first layer 221, however, is composed of more dense foam than the second layer 223 and acts to prevent tearing of the pad both during manufacture and use, while the second layer 223 acts as a shock continuation material absorbing shock during the use of the pad 220. Preferably the foam used to construct the first 221 and second 223 layers of the pad 220 is high density foam.

As best seen in FIG. 10, slits 227 are cut into the portion of the trampoline safety pad 220 that wraps around the trampoline frame 216. In preferred embodiment the slits 227 are rectangular in length and run the complete length of the trampoline safety pad 220. The slits, however, are cut into and only penetrate the second layer 223 of the trampoline safety pad 220.

The third embodiment of the trampoline safety pad 220 acts to cover the trampoline springs 212. In a preferred embodiment, the pad 220 completely covers the area between the trampoline frame 210 and the bouncing surface 214. However in some embodiments, the springs 212 may be longer than the width of the pad 220. The edge of the pad 220 opposite the bouncing surface 214 preferably wraps partially around the horizontal frame member 216.

A pair of grommets 233 are disposed at each end of the trampoline safety pad 220. In a preferred embodiment the grommets 233 are circular in shape and penetrate the thickness of the pad 220; they pass through both the first layer 221 and the second layer 223 of the pad 220. The grommets are preferably made of rubber but may be composed of alternative materials such as plastic or steel. As seen in FIG. 9, one grommet 233(*a*) is at the end of the pad 220 and located on the edge of the pad 220 nearest the bouncing surface 214. Another grommet 233*b* is also positioned on the end of the pad 220; however, it is located on the edge of the pad 220 that wraps around the horizontal frame member 216. The grommets 233 are designed to accommodate cords 234.

As shown in FIGS. 8 and 9 a central grommet 232 is disposed on the trampoline safety pad 220. In a preferred embodiment, the central grommet 232 is circular in shape and penetrates the thickness of the pad 220. The central grommet 232 is preferably made of rubber and is located on the edge of the pad 220 that wraps around the horizontal frame member 216 and is disposed half way between both ends of the pad 220. The central grommet 232 is designed to accommodate a cord 234.

In FIG. 8, cords 234 are shown passing through the pairs of grommets 233 as well as the central grommet 232. In a preferred embodiment the cords 234 are bungee cords. The cords 234 are preferably made of an elastic type material, such as rubber.

The following explains the method of attaching the third embodiment of the trampoline safety pad 220 to the trampoline frame 210. A first pad 220 is placed upon the horizontal frame members 216 and the springs 212, then a cord 234 is passed through the central grommet 232 and used to tie the pad 220 to the horizontal frame member 216. Next, a second pad 220 is placed adjacent to the flap 225 edge of the first pad 220. The edge of the second pad 220 that does not have a flap is inserted underneath the flap 225 of the first pad. Finally, cords 234 are passed through the pairs of grommets 233. First, a cord 234 is passed through the grommets 233*b* proximate the bouncing surface 214 edge of the pad 220 and is tied so as to secure the first and second pads 220 together. Next, a cord 234 is passed through the grommets 233*a* that are proximate the edge of the pad 220 that is near the horizontal frame member 216. This cord 234 is then tied to the leg joining tube 217 so as to fix the pad 220 to the frame 210.

The following steps describe a method of manufacturing the third embodiment of the trampoline safety pad 220. A first layer 221 of closed cell foam is unrolled on top of a second layer 223 of closed cell foam. Next, the first 221 and second layer 223 of foam are cut into preferably a trapezoidal shape that has a flap on one edge. Third, the first 221 and second 223 layers are laminated together using a heat sealing method. Fourth, multiple slits 227 are cut in the second layer 223 at the portion of the pad 220 that wraps around the horizontal frame member 216. Fifth, holes are punched into the combined layers of foam that pass all the way through both layers. Finally, grommets are pressed into the openings.

The previously described embodiments of the present invention have many advantages, including the fact that in one embodiment the trampoline safety pad 20 shifts with use because instead of being tied to the frame it is wrapped around the frame and thus more secure. Also, the closed cell, dense polyethylene foam used for the pad 20 is much sturdier than die cut foams. Further, because the trampoline safety pad 20 is attached in sections, one section may be replaced as opposed to purchasing an entire cover for the trampoline.

The previously described methods of manufacturing the present invention have many advantages, including the fact that the cost of producing the closed cell polyethylene foam pad in the foregoing manner is about ⅓ of the cost required to produce similar low grade polyethylene die cut foam pads that are covered by fabric and have ties attached to secure the pads to the frame.

It should be understood that many changes and modifications can be made to the embodiments described above. It is therefore intended that the foregoing detailed description be understood as an illustration of the presently preferred embodiments of the invention, and not as a definition of the invention. It is only the following claims, including all equivalents, that are intended to define the scope of this invention.

What is claimed is:

1. A trampoline safety pad comprising:

a) a plurality of pad members sized and shaped to substantially cover trampoline springs and horizontal frame members of a trampoline, wherein the pad members wrap partially around the horizontal frame members, each pad member comprising:

(i) a top layer of polymeric material having an exposed upper surface; and (ii) a bottom layer of polymeric foam laminated to the top layer opposite to the exposed upper surface, the top layer being denser than the bottom layer of foam, the bottom layer being thicker than the top layer and the pads having at least one hole extending through both layers;

b) connectors to secure the pad members to the trampoline frame, the connectors utilizing the holes through the pad members; and c) connectors to secure pad members to one another in an abutting relationship wherein an end of a bottom foam layer of one pad member abuts an end of a bottom foam layer of an adjoining pad member.

2. The trampoline safety pad of claim 1 wherein the connectors securing the pad members to the frame comprise bungee cords.

3. The trampoline safety pad of claim 1 wherein the connectors to secure pad members to one another comprise pieces of polymeric material located above the abutment between bottom foam layers.

4. The trampoline safety pad of claim 2 wherein the pieces of polymeric material located above the abutments between bottom foam layers each comprise an extension of the top layer of one of the abutting pads.

5. The trampoline safety pad of claim 2 wherein the connectors to secure the pad members further comprise bungee cords.

6. The trampoline safety pad of claim 1 wherein the pad members are trapezoidal shaped.

7. The trampoline safety pad of claim 1 further comprising grommets positioned at the ends of the pads.

8. The trampoline safety pad of claim 7 further comprising central grommets located on edges of the pads.

9. The trampoline safety pad of claim 8 further comprising a plurality of cords running through the grommets to secure the pad members to one another and to secure the pad members to the horizontal frame members.

10. The trampoline safety pad of claim 1 wherein the top layer of polymeric material comprises a high density foam.

11. The trampoline safety pad of claim 1 wherein the bottom layer of polymeric material comprises a closed cell foam.

12. The trampoline safety pad of claim 1 wherein the top layer and bottom layer are laminated to one another using a heat sealing method.

13. A trampoline safety pad comprising:

a) a plurality of pad members sized and shaped to substantially cover trampoline springs and horizontal frame members of a trampoline, wherein the pad members wrap partially around the horizontal frame members, each pad member comprising:

(i) a top layer of high density, closed cell polymeric foam material having an exposed upper surface; and (ii) a bottom layer of closed cell polymeric foam laminated to the top layer opposite to the exposed upper foam surface, the top layer of foam being denser than the bottom layer of foam, the bottom layer of foam being thicker than the top layer of foam and the pads having at least one hole extending through both layers of foam;

b) connectors to secure the pad members to the trampoline frame, the connectors utilizing the holes through the pad members; and c) connectors to secure pad members to one another in an abutting relationship wherein an end of a bottom foam layer of one pad member abuts an end of a bottom foam layer of an adjoining pad member, the connectors comprising pieces of polymeric foam located above the abutment between bottom foam layers of adjoining pad members.

* * * * *

UNITED STATES PATENT AND TRADEMARK OFFICE

CERTIFICATE OF CORRECTION

PATENT NO. : 6,001,045

DATED : December 14, 1999

INVENTOR(S) : J. Paul Gift et al.

It is certified that error appears in the above-identified patent and that said Letters Patent is hereby corrected as shown below:

On the Title Page

In column 2, before line 1, under "U.S. PATENT DOCUMENTS", insert:

--3,233,895 2/1966 Grelle et al.--.

In column 2, after line 1, under "U.S. PATENT DOCUMENTS", insert:

| | | |
|---|---|---|
| --4,045,021 | 8/1977 | Nissen |
| 4,139,192 | 2/1979 | McNeil |
| 4,284,271 | 8/1981 | Pettit et al. |
| 4,331,329 | 5/1982 | Mirkovich et al. |
| 4,341,379 | 7/1982 | Milligan |
| 4,386,772 | 6/1983 | Wu |
| 4,477,083 | 10/1984 | Sowards |
| 4,478,420 | 10/1984 | Sowards |
| 4,900,011 | 2/1990 | Nolet--. |

UNITED STATES PATENT AND TRADEMARK OFFICE

CERTIFICATE OF CORRECTION

PATENT NO. : 6,001,045

DATED : December 14, 1999

INVENTOR(S) : J. Paul Gift et al.

It is certified that error appears in the above-identified patent and that said Letters Patent is hereby corrected as shown below:

On the Title Page (cont'd)

In column 2, after line 2, under "U.S. PATENT DOCUMENTS", insert:

--5,545,110 8/1996 Hsiang

FOREIGN PATENT DOCUMENTS 2 398 518 2/1979 France--.

In the Claims

In claim 4, line 1, delete "claim 2" and substitute --claim 3-- in its place.

In claim 5, line 1, delete "claim 2" and substitute --claim 3-- in its place.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*